United States Patent [19]

Maus et al.

[11] 4,285,393

[45] Aug. 25, 1981

[54] HEAT EXCHANGER FOR HIGH-TEMPERATURE GASES

[75] Inventors: Wolfgang Maus; Wolfgang Niemeyer; Helmut Swars, all of Bergisch Gladbach, Fed. Rep. of Germany

[73] Assignee: GHT, Gesellschaft Für Hochtemperaturreaktor-Technik mbH, Bergisch Gladbach, Fed. Rep. of Germany

[21] Appl. No.: 87,255

[22] Filed: Oct. 22, 1979

[30] Foreign Application Priority Data

Oct. 26, 1978 [DE] Fed. Rep. of Germany ..... 2846581

[51] Int. Cl.[3] ..... F28D 7/06; F28F 9/02

[52] U.S. Cl. ..... 165/76; 122/32; 165/11 A; 165/82; 165/134 R; 165/160; 165/162; 165/163; 165/176

[58] Field of Search ..... 165/176, 163, 82, 76, 165/11 A, 134 R, 160, 162; 122/32, 34, 483

[56] References Cited

U.S. PATENT DOCUMENTS

| | | | |
|---|---|---|---|
| 2,468,903 | 5/1949 | Villiger | 165/83 |
| 3,156,296 | 11/1964 | Kelp | 165/176 |
| 3,596,638 | 8/1971 | Michel | 122/32 |
| 3,603,383 | 9/1971 | Michael et al. | 165/158 |
| 3,741,167 | 6/1973 | Polcer et al. | 122/32 |
| 3,850,231 | 11/1974 | Creek | 122/32 |
| 4,084,546 | 4/1978 | Schneeberger et al. | 165/163 |
| 4,098,329 | 7/1978 | Culver | 122/32 |
| 4,148,281 | 4/1979 | Stoll et al. | 165/82 |

FOREIGN PATENT DOCUMENTS

| | | | |
|---|---|---|---|
| 989963 | 4/1965 | United Kingdom | 165/163 |

*Primary Examiner*—Sheldon Richter

*Attorney, Agent, or Firm*—Herbert L. Lerner; Laurence A. Greenberg

[57] ABSTRACT

A U-tube heat exchanger for the heat transfer from a primary gas circuit to a secondary gas circuit in a high temperature reactor. At the high temperatures of approximately 950° C., the additionally permissible stresses on the used materials are low. The cold gas collector is therefore flexibly attached at the housing. The arrangement permits complete and also remote-controlled testing from the secondary gas-side of all parts of the primary gas circuit which are stressed by pressure. The flexible elements are neither stressed by the weight of the heat exchanger nor endangered by high temperatures.

11 Claims, 5 Drawing Figures

B-B

HEAT EXCHANGER FOR HIGH-TEMPERATURE GASES

BACKGROUND OF THE INVENTION

1. Field of the Invention

This invention relates to a heat exchanger for gases at high temperature, in particular to the heat transfer of a high temperature reactor from a primary gas circuit to a secondary gas circuit, with the secondary gas conducted through multiple, parallel connected U-tubes in counterflow to the primary gas.

2. Description of the Prior Art

Heat exchangers having heat transfer surfaces consisting of U-tubes have considerable advantages compared to straight tubes, particularly as evaporators, because the U-tubes are fixedly connected at both of their ends, but can freely expand with their U-bends with respect to the housing, or with respect to their suspension. U-tube heat exchangers also have important advantages compared to heat exchangers with helical tubes which have been proposed for high temperature gases. They are easier to manufacture, and also easier to install and, therefore, more advantageous pricewise. U-tubes are easier to check after the installation and also after more extended operating time. They also can be repaired with greater ease, because one can examine and test the long, straight legs of the U-tubes from inside readily and reliably by means of long probes, a task that is very difficult with heat exchangers with helical tubes because of their complicated shape. Furthermore, a gas-heat exchanger which is operated using counterflow has only a small, and over the length of the tube approximately constant temperature difference between the primary and the secondary medium, so that temperature differences of a magnitude large enough to cause impermissible tension cannot occur in the tubes themselves, nor in their suspensions, nor in the channel walls surrounding the tubes. Notwithstanding these advantages, there are, however, considerable problems when using a U-tube heat exchanger for gases at 950° C. For example, with such hot gases one must separate the cold gas lead-in line from the heated gas lead-out line. The corresponding cold and hot gas collectors must be different spacewise and constructionwise, to avoid stresses (tension) between construction members at different temperatures, and also to avoid undesirable heat losses. The gas input, the gas output lines and the corresponding collectors for the cold and hot gas are of large dimensions, at varying operating conditions cause very different expansions, particularly in the longitudinal direction. The U-tubes themselves cannot absorb these expansions because, at the high temperatures, the additional stresses still permissible for the materials used, are low.

SUMMARY OF THE INVENTION

An object of the present invention is to provide a heat exchanger for high temperature gases which will avoid or minimize stresses due to temperature differences in the heat exchanger. Another object of the invention is to provide a heat exchanger capable of being tested thoroughly and, if used for nuclear reactor installations, capable of being tested remotely controlled from the secondary gas side, without the necessity to open the primary gas circuit.

With the foregoing and other objects in view, there is provided in accordance with the invention a heat exchanger for high temperature gases, particularly for the heat transfer from a primary gas circuit to a secondary gas circuit in a high temperature nuclear reactor, with the secondary gas flowing counter-current to the primary gas, comprising a heat exchanger housing, a plurality of U-tubes with vertical legs connected in parallel through which the secondary gas flows, contained in the housing, passageways adjacent the legs of the U-tubes for the counter-current flow of primary gas, an inlet and an outlet in the housing for the introduction and discharge of primary gas into and out of the passageways, a hot gas collector into which hot secondary gas from the hot end of the U-tubes discharges, a cold gas collector from which the colder secondary gas enters the U-tubes, said U-tubes at their hot ends being fastened to said hot gas collector, said hot gas collector being fixedly connected in a longitudinal direction at the housing, and said cold gas collector being flexibly fastened at the housing.

Other features which are considered as characteristic for the invention are set forth in the appended claims.

Although the invention is illustrated and described herein as embodied in a heat exchanger for high-temperature gases, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
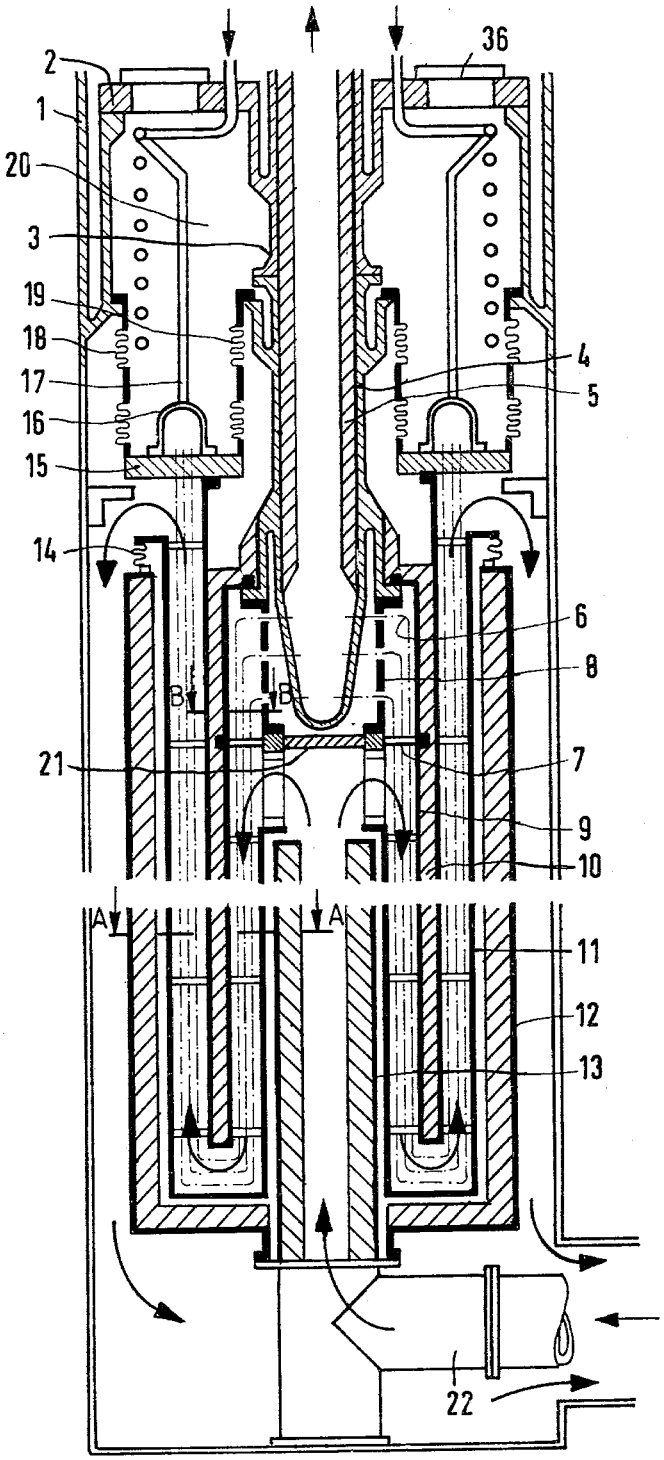
FIG. 1 shows a vertical longitudinal section through a heat exchanger for a gas cooled high temperature-reactor according to the invention in a schematic representation.

The heat exchanger of the invention will operate satisfactorily with temperatures of approximately 950° C., and with temperature differences of 650° C. between the entrance and exit of the gases, and will under these conditions of operation avoid stresses due to temperature differences to a great extent.

The heat exchanger of the present invention avoids stresses because the U-tubes themselves and the cold gas collector which is fastened to them can freely expand with respect to the hot gas collector and the housing. The cold-gas collector can be connected to the housing by conventional flexible elements, as for example by corrugated tubes, because the cold gas collector in the gas-heat exchanger which is operated with counterflow is not endangered by high temperatures, on either the primary- or the secondary side. The construction members of the cold-gas collector are protected from the high temperatures of the hot-gas collector by spatial separation and by suitable insulation. The flexible elements are not under load by the weight of the U-tubes.

A double separating wall of U-shaped cross section between the two legs of the U-tubes serves as a load carrying connection between the fixed hot gas collector and the cold gas collector for the secondary gas, which cold gas collector is flexibly arranged in the axial direction. The separating wall, in a heat exchanger which is operated with counter-flow, has in each area a temperature which is only slightly different from the temperature of the neighbouring heat exchanger tube. This separating wall has the same temperature as the neighbouring heat exchange tube even when the gas temperature changes due to operating conditions since the separating wall is thinwalled and insulated at one side and has on the other side a gas stream of great velocity flowing against it. Accordingly, the separating wall expands correspondingly approximately the same amount as the neighboring tube. As a result, the expansions that can occur between the tubes and the separating wall are not very different, and this wall is utilized not only as gas duct, but also as a supporting construction member between the hot-gas collector and the cold-gas collector.

The space chamber containing the cold gas collector, disposed above and separated from the primary gas circuit, is of importance in heat exchangers for nuclear energy installations, because the primary gas circuit contains necessarily radioactive contaminants. If one fills this space with pure (without radioactive contaminants) primary medium and makes certain that the pressure in this room is always the same as in the primary gas circuit by means of a suitable regulator-control or by pressure equalization over a filter, said space is not endangered by the high pressure in the primary gas circuit. If a slightly higher pressure is maintained in this space than in the primary gas circuit, it makes it certain that no radioactive contaminants can enter this space even if small leaks exist in the primary gas circuit. The pressure in the primary gas circuit is reduced for testing or repairing the heat exchanger so that one can open this space from the outside safely, and one can test from this space the collectors, U-tubes and walls of this space, without the need to open the primary gas circuit. This space includes flexible elements in its construction because it does not include the primary gas circuit in its boundaries.

A particularly practical arrangement for a heat exchanger in accordance with the present invention is one in which the hot gas collector is arranged centrally, and the cold gas collector is arranged in ring-form and concentrically to the hot gas collector within a cylindrical housing. The hot-gas collector which is particularly exposed to high temperatures has, being for the most part a straight, cylindrical tube, a simple geometrical form whose required parameters can be clearly and exactly calculated. Also the insulation can be easily and reliably secured in such geometrically simple construction member. The cold-gas collector which is stressed to considerably lesser degree due to the lower gas temperature is in a ring-shape concentrically surrounding the hot-gas collector, and is connected to the latter and to the housing by flexible elements. These flexible elements can either be two concentric corrugated tubes, arranged one in the other, and forming an annular space, or several corrugated tubes of lesser diameter, distributed around the circumference.

The hot ends of the U-tubes are secured in a holder arranged at the central hot gas collector and lead from there to the hot gas collector, with each said hot end having an elastic tube bend. The mounting of the U-tubes transfers the weight of the U-tubes and their forces to the central hot-gas collector, so that the U-tubes, which from this mounting to the central hot-gas collector are conducted with a bend, have to absorb only the small forces which can result from a differential expansion of the hot-gas collector and the mounting.

The central hot-gas collector is of conical shape in the region where the U-tubes enter. The conical form of the central hot-gas collector, makes it possible to connect the vertical U-tubes, which are arranged at differing distances from the middle of the collector, with the same bend to the central hot-gas collector, so that the tensions in all tube bends are equal.

An insulating wall between the central hot-gas collector and the primary gas entrance, separates this collector from the hot primary gas circuit. Therefore, this collector can only reach the temperature of the secondary gas, which is approximately 50° C. below the temperature of the primary gas. At the high temperatures involved here a temperature lower by 50° is of importance for the strength of the collector.

The U-tubes have two concentric sheet metal shells—an uninsulated inner shell adjacent the U-tubes and an outer insulated shell separated from the inner shell by a gap with the gap open at the hot end and closed at the cold end by a flexible element. The purpose of sheet metal shells is to compel the hot primary gas to flow along the U-tubes with heat exchange with the latter, and to prevent heat exchange between two hot-gas streams of different temperature. Therefore, there is first, an uninsulated sheet metal provided directly adjacent to the U-tube bundle, which shell has about the same temperature as the tube bundle, and therefore expands as does the latter. Another insulated sheet metal shell is fastened to the housing, and therefore expands independently of the tube bundle. The gap between these two sheet metal shells is only at its cold end. This gap is closed by a flexible element, for example a corrugated tube is used. As a result, none of the primary gas is by-passed through the gap and then discharged, but the primary gas must first pass in heat exchange with the U-tubes before discharge. The advantages of the gas-heat exchanger of the present invention are evident. At the cold end only relatively low temperatures can occur, thus placing the flexible elements required for reliable sealing out of danger. The wave-shaped cross section of the sheet metal shells solves two different problems. The sheet metal shells are yielding in the direction of the circumference, so that they can expand together with the tube bundles. Also, if the spacing of the waves corresponds to the spacing of the adjacent tube bundles, it avoids forming channels between the U-tubes and the sheet metal shells in which the gas finds a lower flow resistance, and flows through there correspondingly faster, and therefore less cooling of the gas results, so that different temperatures may be expected over the cross-section.

A support is provided below the cold gas collector at the housing. The upper part of the hot gas collector is detachable and can be extended upwardly. The support is intended to carry the cold gas collector and the structural parts fastened to it during inspections and during repairs, so that the upper part of the hot gas collector can be removed and its lower part can be tested. Furthermore, this support can serve as protection against a fall, i.e. drop of the heat exchanger, and also as a limitation of vibration occurring at an earthquake.

FIGS. 1 to 5 illustrate embodiments of the invention. In FIG. 1 the cylindrical heat exchanger housing 1, which is closed all around, is bounded at its upper end by a carrier plate 2, onto which an upper, central hot gas tube 3 is secured. Beneath is a lower, central hot gas collector 4 with a conical bottom part. Both the upper and lower parts 3 and 4 are protected inside by the insulation 5. The hot ends of the U-tubes 6, which are secured at 7, and are carried by the central hot gas collector 4 by means of a special mounting support 8, discharge into the lower, conical part (which need not be insulated) of the central hot gas collector 4. Furthermore, this collector 4 carries a double walled separating wall 9, which is also U-shaped in longitudinal section, and filled with an insulation 10. The U-tubes 6 form a ring-shaped tube bundle, which is bounded, inside and outside, first by a concentric, not insulated sheet metal shell 11 of U-shaped longitudinal section, and then by two concentric, insulated sheet metal shells 12 and 13. Between these shells a gap is provided which is sealed flexibly at the cold end by a corrugated tube 14. The U-tubes 6 and the double-walled separating wall 9 carry at their cold end a ring-shaped tube plate 15. A ring-shaped cold gas collector 16 is secured to the upper side of plate 15, in such manner that it can be removed. Several cold gas tubes 17, which are distributed around the circumference and shaped similar to a helix, which conduct the cold secondary gas to the U-tubes 6 from the outside, discharge into collector 16. The tube plate 15, together with the upper end of the housing 1, with the carrier plate 2 and with two concentric corrugated tubes 18 and 19, form a chamber 20. Chamber 20 is separated from the primary gas circuit below, and also encloses the tubes 17 as shown in FIG. 1. Chamber 20 is filled with the pure medium of the primary gas circuit during operation of the equipment, and is kept at the pressure of the primary circuit by means of a control device which is not shown or by means of a pressure equalizer. In this manner the chamber 20 is not affected by pressure differences, and can be opened from the outside when the pressure in the primary gas circuit is reduced, and this can be used for inspection and repair of the collector and the U-tubes, without the need of opening the primary gas circuit. An insulating wall 21, which is secured to mounting support 8 and which separates the hot gas collector 4 from the primary gas circuit is provided below the hot gas collector 4.

The flow arrangement of the two heat exchange media are as follows: The hot primary gas enters through the short, horizontal tube 22 into the central, insulated sheet-metal shell 13, is deflected below the insulating wall 21, and flows first downward and then upward along the U-tubes 6 through a space which is formed by the sheet metal shell 11 and the separating wall 10. At a point below the tube plate 15, the primary gas, which meanwhile has cooled, is deflected downward and flows between the sheet metal shell 12 and the housing 1 in a downward direction.

The cold secondary gas flows into the ring-shaped collector 16 through several tubes 17 which are coiled in a helix type shape in each other. The secondary gas flows from collector 16 through the U-tubes 6 which are fastened to the tube plate 15, to the hot gas collector 4, and is discharged from the upper hot gas tube 3.

Figure 2:
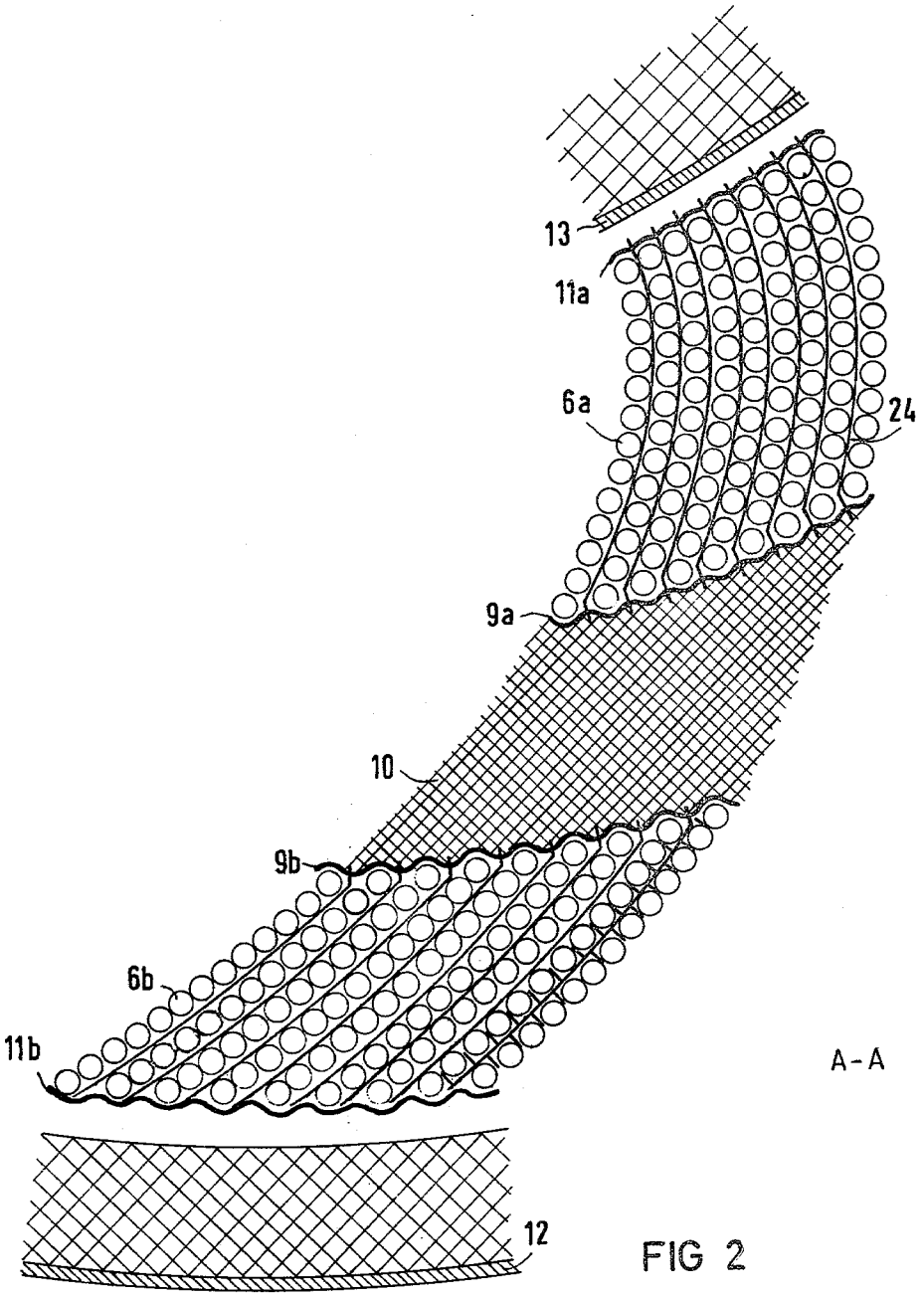
FIG. 2 shows an enlarged partial horizontal section of the heat exchanger taken along line A—A of FIG. 1.

In FIG. 2, using the same designations as were used in FIG. 1, is shown in cross-section, how the U-tubes 6 are arranged with the cold leg designated *6b* and the warm leg *6a*. In the gas heat exchangers proposed here, the temperature of the primary gas should not have great differences in the cross-section in order to obtain the smallest possible heat tensions. Therefore, the flow resistance and thereby also the free cross-sections outside of the U-tubes should be fairly uniform in section from outside toward the inside. Consequently, it was found advantageous to arrange the individual U-tubes with constant distribution in vertical surfaces, which in the FIG. 2 consist of thirteen U-tubes 6 each, and which can be pre-assembled in the workshop. They can then be installed in the concentric sheet-metal shell 11 as a completed surface. Observed from the inside toward the outside, the insulated sheet metal wall 13 which guides the entering hot primary gas, is surrounded by the inner sheet metal shell *11a*, spaced a proper distance and said shell together with the inner separating wall *9a* bounds the hot legs *6a* of the U-tubes 6, while the outer separating wall *9b* together with the outer sheet metal shell *11b* forms the boundary for the cold legs *6b* of the U-tubes 6. The insulated sheet metal shell 12 is, spaced a proper distance arranged ouside of sheet metal shell *11b*, and metal shell 12 together with the housing 1 (not shown in FIG. 2) forms an annular channel for the down-streaming, cooled primary gas. In FIG. 2 the separating walls 9, and the sheet metal shells 11 are shown with a corrugated (wavy) cross-section. The advantages of this corrugated cross-section were explained. Horizontal distance spacers 24 which are inserted into suitable slots in the separating wall 9 and the sheet metal shell 11 during the assembly, and gastight welded in position are provided between the mentioned involute curved surfaces of the U-tubes 6.

Figure 4:
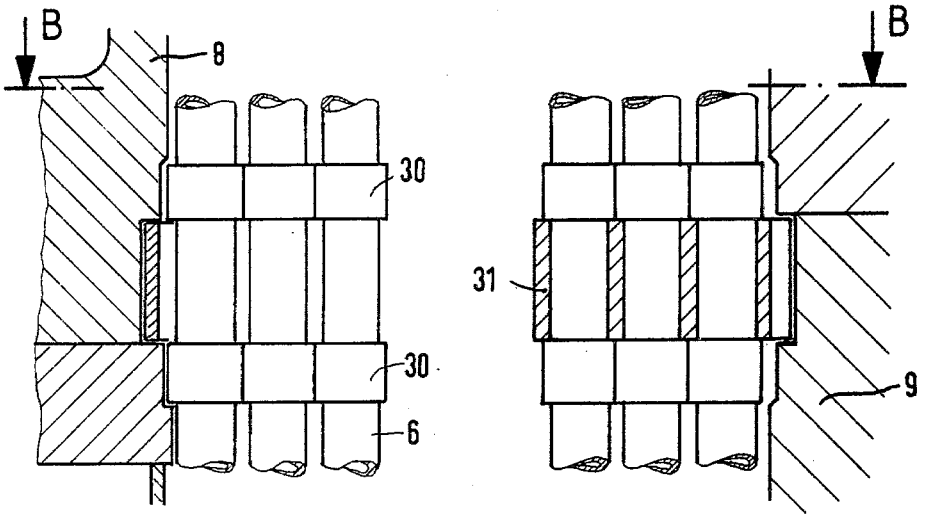
FIG. 4 shows a vertical view of the heat exchanger section shown in FIG. 3.
Figure 3:
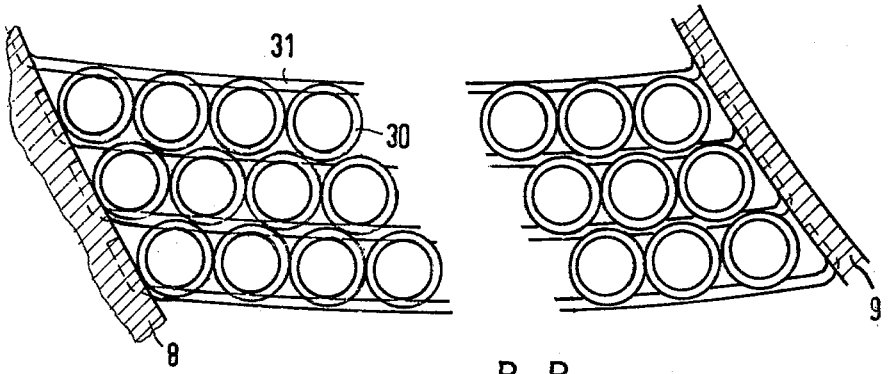
FIG. 3 shows another enlarged partial section of the heat exchanger taken along line B—B of FIG. 4.

How the hot ends of the U-tubes 6 are fastened between the mounting support 8 and the separating wall 9 is shown in FIGS. 3 and 4. Two cylindrical sleeves 30 are secured to the U-tubes 6, a short distance on top of each other, for example by high temperature brazing. At the assembly, suitable sheet metal strips 31 are positioned between the two sleeves 30. These sleeves are bent to an involute form, and angled off at both ends, so that they sit into corresponding recesses of the support mounting 8, respectively of the separating wall 9.

Figure 5:
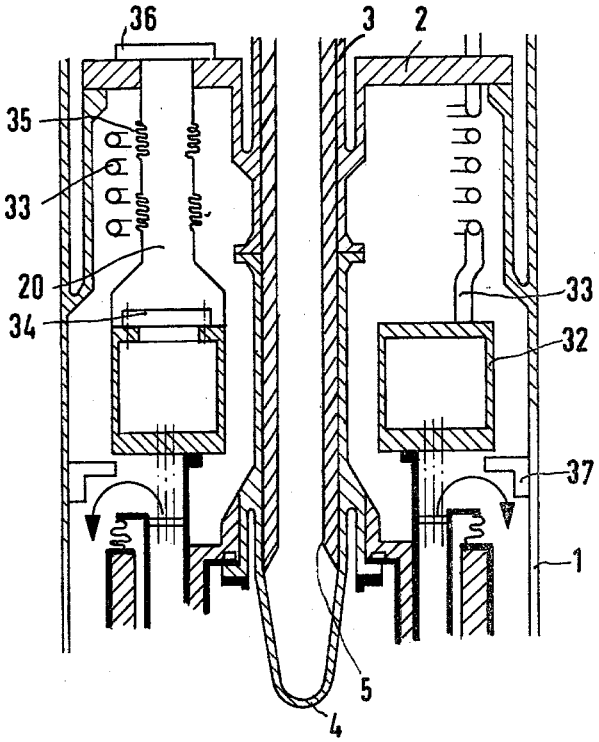
FIG. 5 illustrates another embodiment of the invention similar to FIG. 1 and shows a partial vertical longitudinal section through a heat exchanger.

FIG. 5 shows the upper part of the heat exchanger housing 1, as another embodiment similar to FIG. 1. The housing 1 is also bounded at its upper end by a carrier plate 2 to which an upper, central hot gas tube 3 is fastened, which also carries a lower, central hot gas collector 4. Instead of the ring-shaped tube plate 15 with the ring-shaped cold gas collector 16 screwed to it, as shown in FIG. 1, a hollow annular cold gas collector 32 is provided, which can be supplied with cold gas from the outside through several cold gas tubes 33 distributed around the circumference, in a manner similar to that shown in FIG. 1. The cold gas collector 32 during normal operation is closed by one or several covers 34, which are arranged inside of a space 20. Space 20 is separated from the primary gas circuit, and has the same function as the corresponding space 20 in FIG. 1, but is considerably smaller, and requires only flexible elements 35 for connection with the carrier plate 2. During operation space 20 is closed with a cover 36, as in FIG. 1, and is maintained at the pressure of the primary gas circuit by means of a controller or equalizer which are not shown. Member 37 is the support for the cold gas collector 32, respectively, for the tube plate 15 of FIG. 1.

We claim:

1. Heat exchanger for high temperature gases, particularly for the heat transfer from a primary gas circuit to a secondary gas circuit in a high temperature nuclear reactor, with the secondary gas flowing counter-current to the primary gas, comprising a heat exchanger housing, a plurality of U-tubes with vertical legs connected in parallel through which the secondary gas flows, contained in the housing, passageways adjacent the legs of the U-tubes for the counter-current flow of primary gas, an inlet and an outlet in the housing for the introductions and discharge of primary gas into and out of the passageways, a hot gas collector into which hot secondary gas from the hot end of the U-tubes discharges, a cold gas collector from which the colder secondary gas enters the U-tubes, said U-tubes at their hot ends being fastened to said hot gas collector, said hot gas collector being fixedly connected in a longitudinal direction at the housing, and said cold gas collector being flexibly fastened at the housing.

2. Heat exchanger according to claim 1 for nuclear reactors having a space chamber containing the cold gas collector, disposed above and separated from the primary gas circuit with said space chamber attached by means of flexible elements, said space chamber having access means to the cold gas collector from outside.

3. Heat exchanger according to claim 1, wherein an insulating wall is disposed between the central hot gas collector for the secondary gas and the primary gas circuit.

4. Heat exchanger according to claim 1, wherein in the housing, below the cold gas collector, a support is provided at the housing for said collector, and wherein the upper part of the hot gas collector is detachable and can be extended upwardly.

5. The heat exchanger according to claim 1 with a separating wall between the two legs of the U-tubes in which the separating wall is double and has a U-shaped cross-section and serves as a load carrying connection between the fixed hot gas collector and the cold gas collector for the secondary gas, which latter is flexibly arranged in the axial direction.

6. Heat exchanger according to claim 5, wherein the separating walls which are adjacent to the U-tubes have corrugated crosssections.

7. Heat exchanger according to claim 1, wherein the housing is cylindrical, the hot gas collector is arranged centrally, and the cold gas collector is arranged in ring-form and concentrically to the hot gas collector.

8. Heat exchanger according to claim 7, wherein the hot ends of the U-tubes are secured in a a holder arranged at the central hot gas collector and lead from there to the hot gas collector, with each said hot end having an elastic tube bend.

9. Heat exchanger according to claim 8, wherein the central hot gas collector is of a conical shape in the region where the U-tubes enter.

10. Heat exchanger according to claim 7, wherein the U-tubes have two concentric sheet metal shells with the inner shell uninsulated and adjacent the U-tubes and the outer shell insulated and separated from the inner shell by a gap, with said gap open at the hot end and closed at the cold end by a flexible element.

11. Heat exchanger according to claim 10, wherein the sheet metal shells which are adjacent to the U-tubes have corrugated crosssections.

* * * * *